US005940933A

United States Patent [19]

Chang

[11] Patent Number: 5,940,933

[45] Date of Patent: Aug. 24, 1999

[54] TELESCOPIC HANDLE FOR A MOP

[76] Inventor: Simon Chang, 8F-5, No.191, Fuhsing N. Rd., Taipei, Taiwan

[21] Appl. No.: 09/048,276

[22] Filed: Mar. 26, 1998

[51] Int. Cl.[6] ..... A47B 95/02

[52] U.S. Cl. ..... 16/115; 16/DIG. 41; 15/144.4

[58] Field of Search ..... 16/115, 110.5, 16/DIG. 41, DIG. 24, DIG. 25; 15/144.4; 81/177.1; 403/109.5, 109.1

[56] References Cited

U.S. PATENT DOCUMENTS 1,327,597 1/1920 Greene ..... 15/144.4
2,902,592 9/1959 Cole ..... 15/144.4
4,524,484 6/1985 Graham ..... 16/115
4,794,663 1/1989 Vosbikian ..... 15/229

*Primary Examiner*—Anthony Knight
*Assistant Examiner*—Alison K. Pickard
*Attorney, Agent, or Firm*—Hedman, Gibson & Costigan, P.C.

[57] ABSTRACT

A telescopic handle includes a first tube securely holding a device at a forward end thereof, a second tube, a collar for detachably coupling the first tube and the second tube and preventing relative movement possible between the first and the second tubes when the tubes are coupled, and a third tube partially receiving the second tube, the second tube being movable within the third tube, the third tube being lockable with the second tube in rotational manner.

1 Claim, 4 Drawing Sheets

TELESCOPIC HANDLE FOR A MOP

FIELD OF THE INVENTION

The present invention relates to a handle for a mop or the like, and more particularly, to a telescopic handle in which a first and a second tube will not be rotated with each other unintentionally.

BACKGROUND OF THE INVENTION

Telescopic handles have proven to be very useful when applied to tools and devices etc., whereby the ergonomic application of the tool is greatly enhanced by an extended length of the handle, yet when the handle is contracted, it can be stored very conveniently. Although a mop is shown as the device attached to the telescopic handle in the following description, it is to be appreciated that any one of a wide variety of tools and devices could be fitted to the telescopic handle of the present invention.

A conventional mop that has a telescopic handle is shown in FIGS. 5 and 6. The mop primarily includes a mop head 60 having a sponge or a plurality of cloth strips for cleaning a floor, a first tube 61 extending from the mop head 60, a second tube 64 threadingly coupled to the first tube 61, and a third tube 65 with a larger diameter than that of the second tube 64 for partially receiving the second tube 64 and allowing it to be movable therein. Moreover, a connector 62 is secured at a distal end of the first tube 61 and has a bore (not numbered) with female thread formed therein. A distal end of the second tube 64 has male thread 63 formed thereon, so that the first tube 61 and the second tube 64 are able to be threadingly secured together via the connector 62.

Referring to FIG. 6, in this mop, the secure coupling between the second tube 64 and the third tube 65 is achieved by an eccentric device 66 disposed at an intersection of the second tube 64 and the third tube 65. The eccentric device 66 has a core 67 securely attached to a distal end of the second tube 64, so that when the second tube 64 is rotated in relation to the third tube 65 (or vice versa), the core 67 will gradually abut an inner surface of the third tube 65 and eventually the second tube 64 and the third tube 65 will be securely connected.

With such a design, a user is able to change a length of the handle as required. However, the second tube 64 and the connector 62 will be separated instead of loosening the abutment of the core 67 of the eccentric device 66 to the inner surface of the third tube 65 while a rotation of the tube 65 with respect to the first tube 61 occurs.

SUMMARY OF THE INVENTION

The object of the present invention is to provide a telescopic handle in which a first tube and a second tube will not be rotated with each other unintentionally

DETAILED DESCRIPTION OF PREFERRED EMBODIMENT

Figure 1:
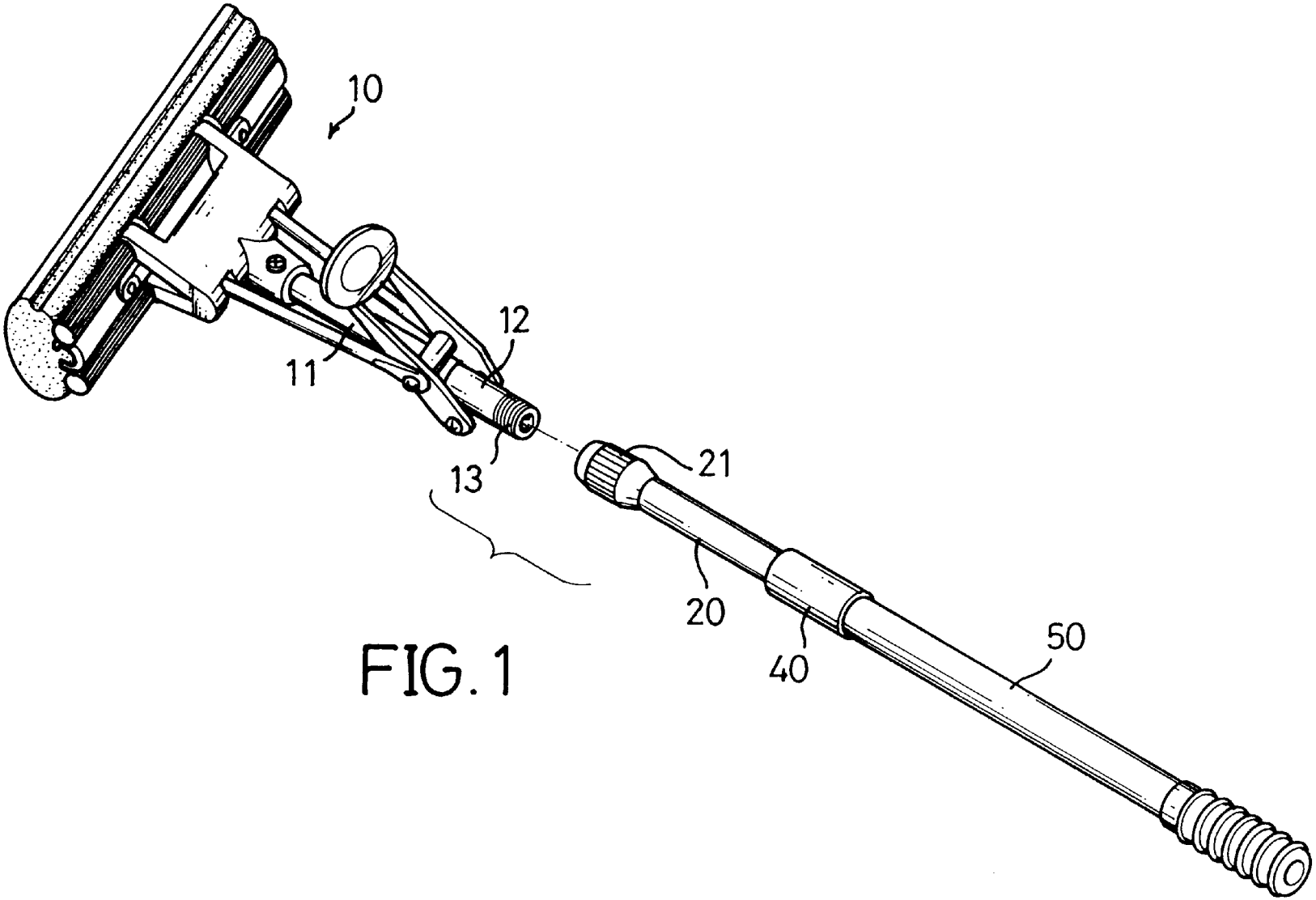
FIG. 1 is a perspective view of a telescopic handle in accordance with the present invention.

Referring to FIG. 1, a telescopic handle for a mop in accordance with the present invention primarily includes a first tube 11 operable to hold a mop head 10 at a forward end thereof, a second tube 20 threadingly and detachably coupled to the first tube 11, and a third tube 50 partially receiving and permitting the second tube 20 to be movable therein. The third tube 50 can be locked with the second tube 20 at any desired place by turning the third tube 50 with respect to the second tube 20 in a rotational direction, and can be unlocked with the second tube 20 vice-versa. As in the prior art, the locking and unlocking may be achieved by means of an eccentric device 40 disposed at an intersection of the second tube 20 and the third 50. Since the eccentric device 40 is similar to that mentioned on the prior art, no description in detail is to be made.

As a significant feature of the present invention, the telescopic handle for a mop is specially provided with means for the detachable coupling of the first tube 11 and the second tube 20 to prevent any relative movement between the first tube 11 and the second tube 20 when they are coupled.

Figure 2:
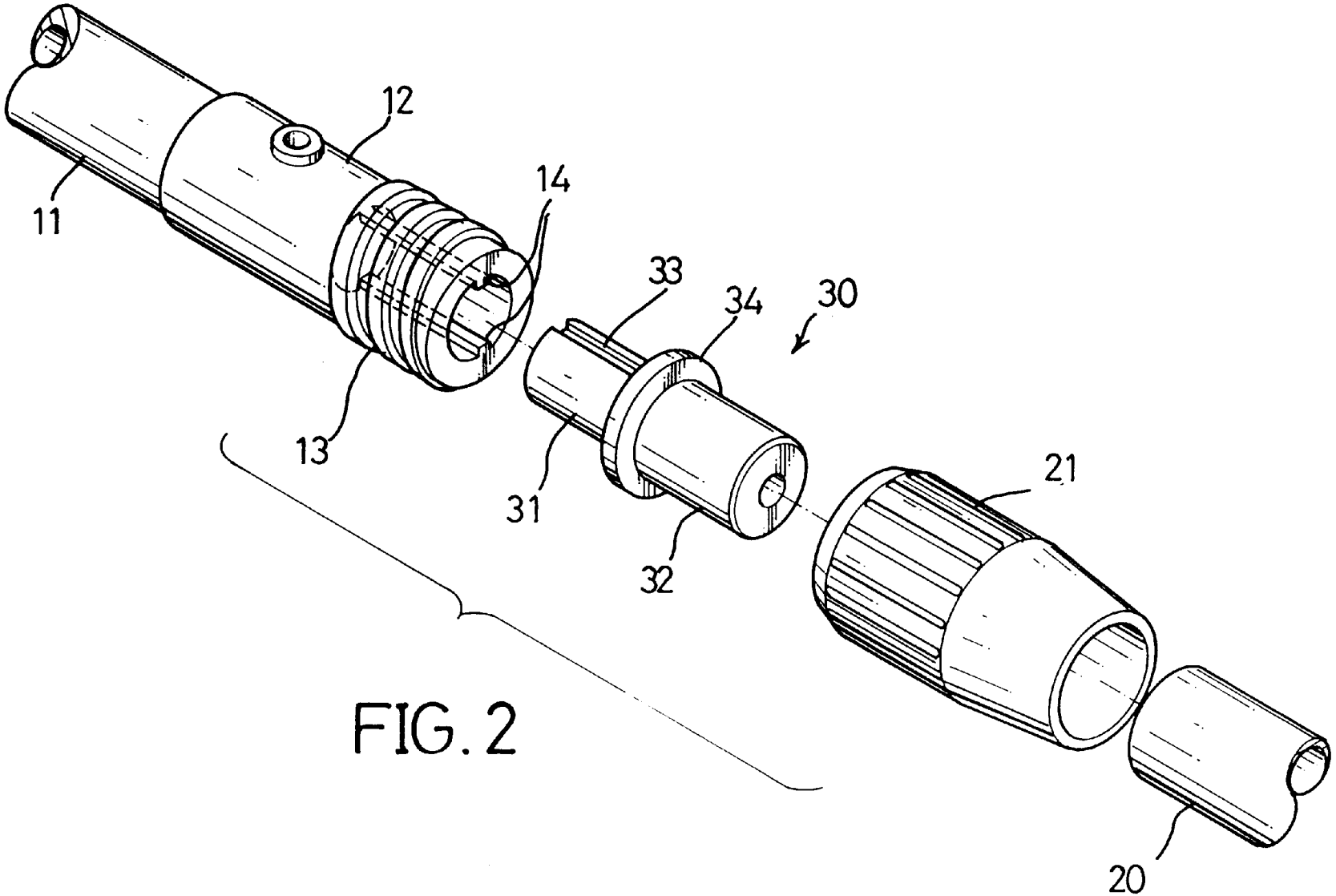
FIG. 2 is a partially exploded view of the telescopic handle shown in FIG. 1.

Referring to FIG. 2, an embodiment of means for the detachable coupling in accordance with the present invention is shown in detail. The means includes a cylindrical female connector 12, a cylindrical male connector 30 and a reducing collar 21.

The cylindrical female connector 12, secured to a rearward end of the first tube 11, has a threaded outer periphery 13 and a pair of opposed keys 14 projected radially from an inner periphery thereof.

The cylindrical male connector 30 secured to an end of the second tube 20 has an annular flange 34 with a diameter larger than that of the female connector 12 but smaller than that of a rear half of the reducing collar 21, a first extension 31 having a pair of opposite slots 33 defined therein and corresponding to the keys 14 of the female connector 12 and a second extension 32 adapted to be securely connected with an end of the second tube 20 and received with the reducing collar 21, such that when the keys 14 of the female connector 12 are respective received in the slots 33 and the second extension 32 is received within the reducing collar 21 and securely connected to the end of the second tube 20, a secure relationship between the first tube 11 and the second tube 20 is achieved.

The collar 21 includes a threaded bore (not numbered) dimensioned to fittingly engage with the threaded outer periphery 13 of the female connector 12, and a neck portion (not numbered) for respective engagement with the annular flange of the male connector 30 and the second tube 20. The collar 21 is movably disposed around the second tube 20 for threaded engagement between the threaded bore and the threaded outer periphery 13 of the female connector 12 while pressing the annular flange 34 of the male connector 30 against the female connector 12, thereby axially fastening the male connector 30 and the female connector 12.

Figure 4:
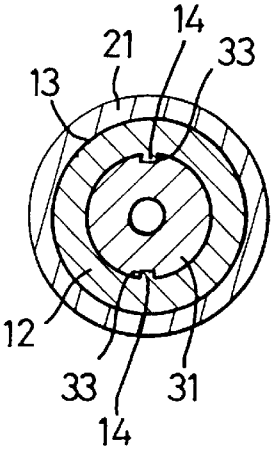
FIG. 4 is a cross-sectional view taken along line 4—4 of FIG. 3.
Figure 3:
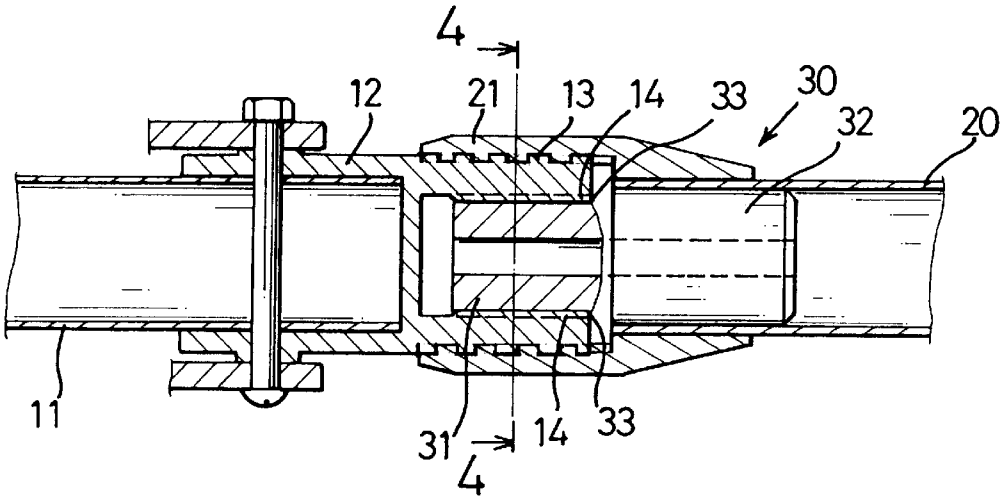
FIG. 3 is partially cross-sectional view of a first tube and a second tube of the handle of the invention.
Figure 6:
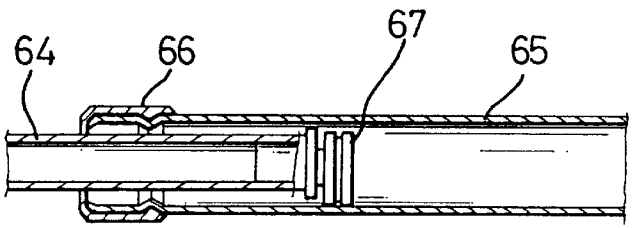
FIG. 6 PRIOR ART
FIG. 6 is a partially cross-sectional view of the conventional handle as shown in FIG. 5.
Figure 5:
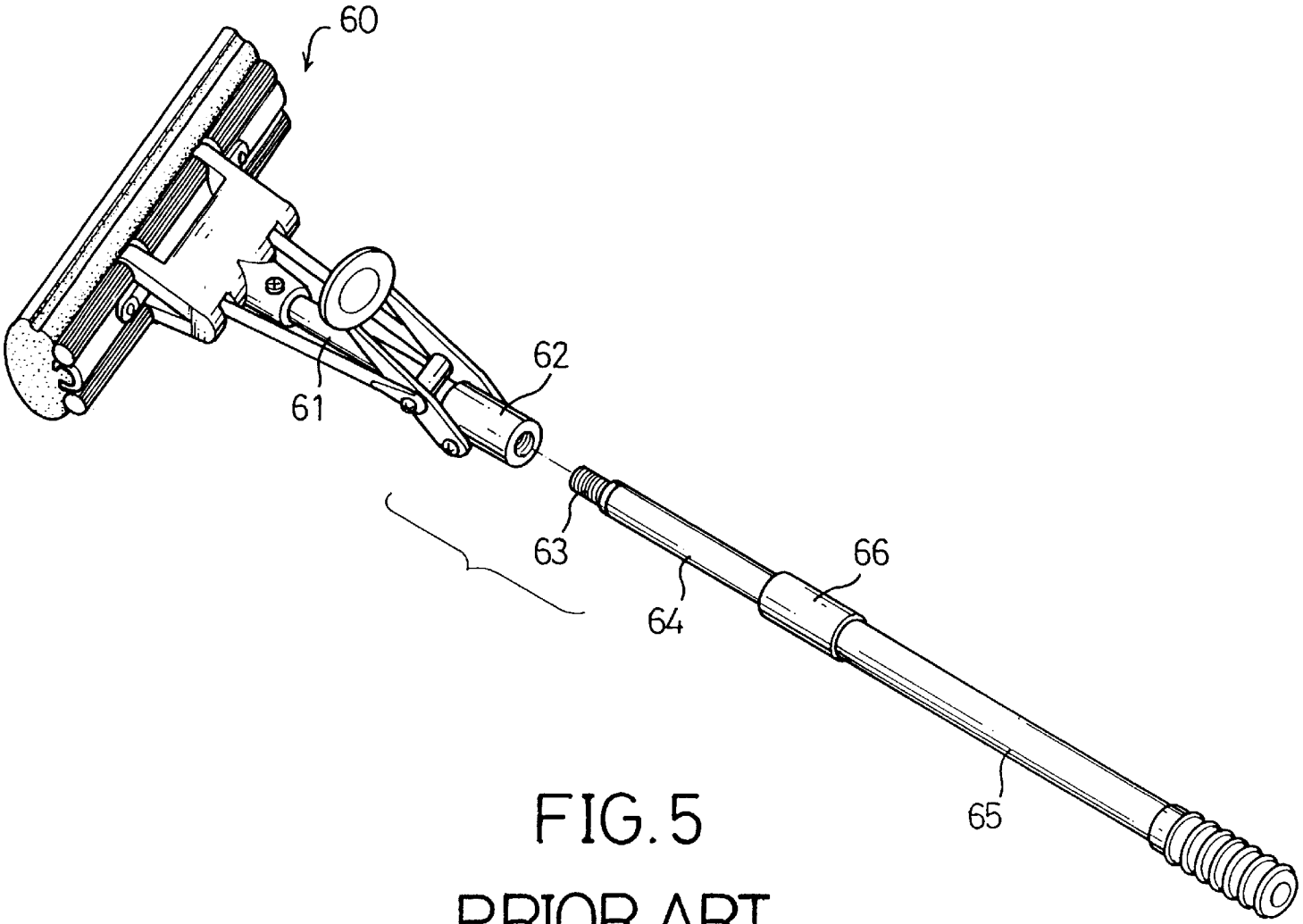
FIG. 5 PRIOR ART
FIG. 5 is a perspective view of a conventional telescopic handle.

Referring to FIGS. 3 and 4, the first tube 11 and the second tube 20 are coupled to each other by inserting the first extension of the male connector 30 into the female connector 12 with the keyslots 33 snugly receiving the keys 14, and screwing the collar 21 onto the threaded outer periphery 13 of the female connector 12, thus urging the collar 21 to press the annular flange 34 of the male connector 30 against the female connector 12.

Referring back to FIG. 1, when the length of the telescopic handle in accordance with the present invention has to be changed, a user may hold the third tube 50 in one hand and the mop head 10 in the other hand, and then rotate the third tube 50 with respect to the mop head 10. At that time, the locking via the eccentric device between the third tube 50 and second tube 20 would solely be released, since the relative rotation possible between the first tube 11 and the second tube 20 is prevented by the keys 14 and the keyslots 33 provided therein.

The telescopic handle in accordance with the present invention is advantageous in that it provides the securement between the first tube 11 and the second tube 20 not only in an axial direction by the annular flange 34 of the male connector 30 and the collar 21, but also in a rotational direction by the keys 14 of the female connector 12 and the keyslots 33 of the male connector 30.

What is claimed is:

1. A telescopic handle, comprising a first tube;

a second tube;

means for detachably coupling said first tube and said second tube without relative movement being permitted between said first tube and said second tube when said first tube and said second tube are coupled, and a third tube partially receiving said second tube, said third tube being detachably connected with said second tube in rotational manner; wherein said means for coupling comprises:

a cylindrical female connector secured to a rearward end of said first tube, said female connector having a threaded outer periphery and at least one key projected radially from an inner periphery thereof;

a cylindrical male connector secured to an end of said second tube opposite to said third tube, said male connector having an annular flange and an extension extending from said flange to be received within said female connector, said extension having at least one keyslot peripherally defined therein to correspond to said at least one key of said female connector, thereby fastening said male and said female connectors peripherally said annular flange preventing said second tube from sliding into said first tube; and a reducing collar movably disposed around said second tube for threadingly engaging said threaded outer periphery of said female connector while pressing said annular flange of said male connector against said female connector, thereby fastening said male and said female connectors axially.

* * * * *